US005967753A

United States Patent [19]

Müller

[11] Patent Number: 5,967,753

[45] Date of Patent: Oct. 19, 1999

[54] CONTROLLABLE-PITCH PROPELLER, ESPECIALLY FOR SPORT BOATS AND OTHER WATERCRAFT

[76] Inventor: Peter Müller, Isengrund 9, CH-8134, Adliswil, Switzerland

[21] Appl. No.: 09/161,895

[22] Filed: Sep. 28, 1998

[51] Int. Cl.[6] ..... B63H 3/04

[52] U.S. Cl. ..... 416/167; 416/93 A; 416/146 A; 416/146 R; 416/147; 416/164; 416/165; 416/166; 416/244 B; 440/50

[58] Field of Search ..... 416/93 A, 146 A, 416/146 R, 147, 164, 165, 166, 167, 244 B, 245 A; 440/50

[56] References Cited

U.S. PATENT DOCUMENTS

| | | | |
|---|---|---|---|
| 3,871,324 | 3/1975 | Snyder | 115/17 |
| 4,599,043 | 7/1986 | Muller . | |
| 4,897,056 | 1/1990 | Muller . | |
| 4,927,393 | 5/1990 | Hayasaka | 440/112 |
| 4,929,204 | 5/1990 | Shiozawa | 440/112 |
| 5,073,134 | 12/1991 | Muller et al. | 440/50 |
| 5,421,756 | 6/1995 | Hayasaka | 440/89 |

*Primary Examiner*—Edward K. Look
*Assistant Examiner*—Matthew T. Shanley
*Attorney, Agent, or Firm*—Herbert Dubno

[57] ABSTRACT

A controllable-pitch propeller for a sport-type watercraft has a push rod eccentrically connected to each blade displaceable in a bore of the propeller hub. The push rod is sealed with respect to the end of that bore by a multifold bellows whose radial flange is clamped by a cap of an axial flange of the housing in which the bore is provided.

18 Claims, 5 Drawing Sheets

CONTROLLABLE-PITCH PROPELLER, ESPECIALLY FOR SPORT BOATS AND OTHER WATERCRAFT

FIELD OF THE INVENTION

My present invention relates to a controllable-pitch or variable-pitch propeller for watercraft, especially for sport boats, of the type in which a plurality of blades are angularly adjustable on a hub to vary the pitch. A pitch-setting mechanism can be provided in the hub and generally includes a push rod eccentrically coupled to a base of a blade and slidable in an axial bore of the hub housing.

BACKGROUND OF THE INVENTION

Controllable-pitch or adjustable-pitch propellers in which a push rod is eccentrically coupled to the or each of the angularly adjustable blades, are known, for example, from U.S. Pat. No. 4,897,056, wherein the positioning of the push rods is effected by hand, or from U.S. Pat. No. 4,599,043, in which an external position mechanism is provided for setting the blade pitch.

The push rods can project from the bores which are open at an end of the hub and are connected to the actuating mechanism. Usually at the beginning of the hub, these bore ends are closed to reduce corrosion and collecting of contaminants which may obstruct the sliding operation of the push rod.

In such cases, between the bore end and the end face of the push rod, an air-filled or gas-filled space is provided, whose volume varies with the change in pitch of the blades. The pressure variation in this space which is associated with the change in volume, acts upon the push rod and thus must be taken up or compensated by the actuating mechanism. This space cannot be enlarged without limit to reduce, for example, the pressure fluctuations because adjacent and between the housings for the push rods, exhaust gas passages may have to be provided in the propeller hub.

Different pressures in the space between the bore ends and the end faces of the push rods, however, cannot ensure a precise adjustment of the pitch. Rather, water can pass the seal and penetrate into the chamber between the push rod and any closure at the end of the push rod bore or otherwise pass into the space in which the end faces of the push rods are exposed. When water penetrates these spaces or chambers and, in particular, enters between the bore ends and the end faces of the push rods, this space is additionally diminished. In cold seasons, the water can freeze and the hub body can burst. When the body is transported from location at high external temperature to a cold location, for example, from a dry dock or trailer to a body of water, the large and rapid temperature fluctuations can create a vacuum in the region of the hub and promote the penetration of water into the pitch control mechanism. The system also is highly sensitive to the formation of ice in the wintertime or whenever the temperature drops sharply.

OBJECTS OF THE INVENTION

It is the principal object of the present invention to provide a controllable-pitch or adjustable-pitch propeller whereby these drawbacks are avoided and, in particular, the pitch of the propeller can be controlled in a simple and effective manner without environmental effect.

It is also an object of this invention to provide an improved variable-pitch propeller in which ice formation tends to be less of a problem and in which the incursion of water to the faces of the push rods is avoided without limitation of the stroke of the push rods.

It is also an object of the invention to provide an improved system for limiting corrosion of the push rods or the push rod bores.

SUMMARY OF THE INVENTION

These objects are attained by providing the bores as open at both ends and at the bore end at the starting side of the hub, by mounting within the bore, a multiply-folded bellows which can expand and contract axially of the bore. The multifold bellows is fastened at this bore end and closes the bore end while enabling pressure equalization in the space between the multiple-fold bellows and the end face of the push rod.

Advantageously the multifold bellows has its closed end turned toward the end face of the push rod while its open end is formed with a peripheral radial flange which can seat against an end face of the housing portions providing the channel receiving the push rod. The multifold bellows can have an outer diameter which corresponds substantially to the inner diameter of the bore at the end thereof at which the channel is provided.

Fastening of the multifold bellows at its open end can be effected by a cap releasably mounted on the housing and whose shoulder can clamp the radial flange against the end of the housing member provided with the bore.

The housing can include an axial flange on which the cap or cover is mounted. The cover can be screwed to the axial flange. It is also possible to clip the cover to the axial flange. The invention also includes an embodiment in which the cover or cap has an axially-extending joint with an inner circumferential rib which engages in an outer peripheral groove of the axial flange.

The cap and/or the axial flange should be composed of a sufficiently yieldable material, preferably an elastic and, for example, a synthetic resin or like material.

Advantageously, the cover can include at least one radial opening which permits water which penetrates into the space between the cover and the multifold bellows to be driven out by centrifugal force during rotation of the propeller.

The controllable-pitch propeller thus can comprise:

a hub having a housing rotatable about an axis of rotation;

a plurality of blades mounted on the housing and each angularly adjustable about a respective adjustment axis transverse to the axis of rotation;

an eccentric mechanism in the hub operatively coupled to the blades for angularly adjusting same about the adjustment axes to set a propeller pitch, the eccentric mechanism including at least one push rod guided in an axially extending bore formed in the housing and having an end open in the hub; and a multiple-fold bellows sealing the end of the bore.

According to a feature of the invention, the multiple-fold bellows can have a closed extremity extending into the end of the bore toward an end of the push rod and lying thereagainst in a normal position of the bellows. The latter can have an outer diameter which is substantially equal to an inner diameter of the bore at the end of the bore provided with the push rod and the cap can press a radial flange of the bellows against an end face of the axial flange formed on the housing around that end of the bore. The cap can have a radial opening, i.e. an opening extending radially with respect to the axis of the bore and can be clipped to the axial flange by an inwardly projecting circumferential rib engaging in a circumferential groove of the axial flange or can be connected thereto by a screw thread.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
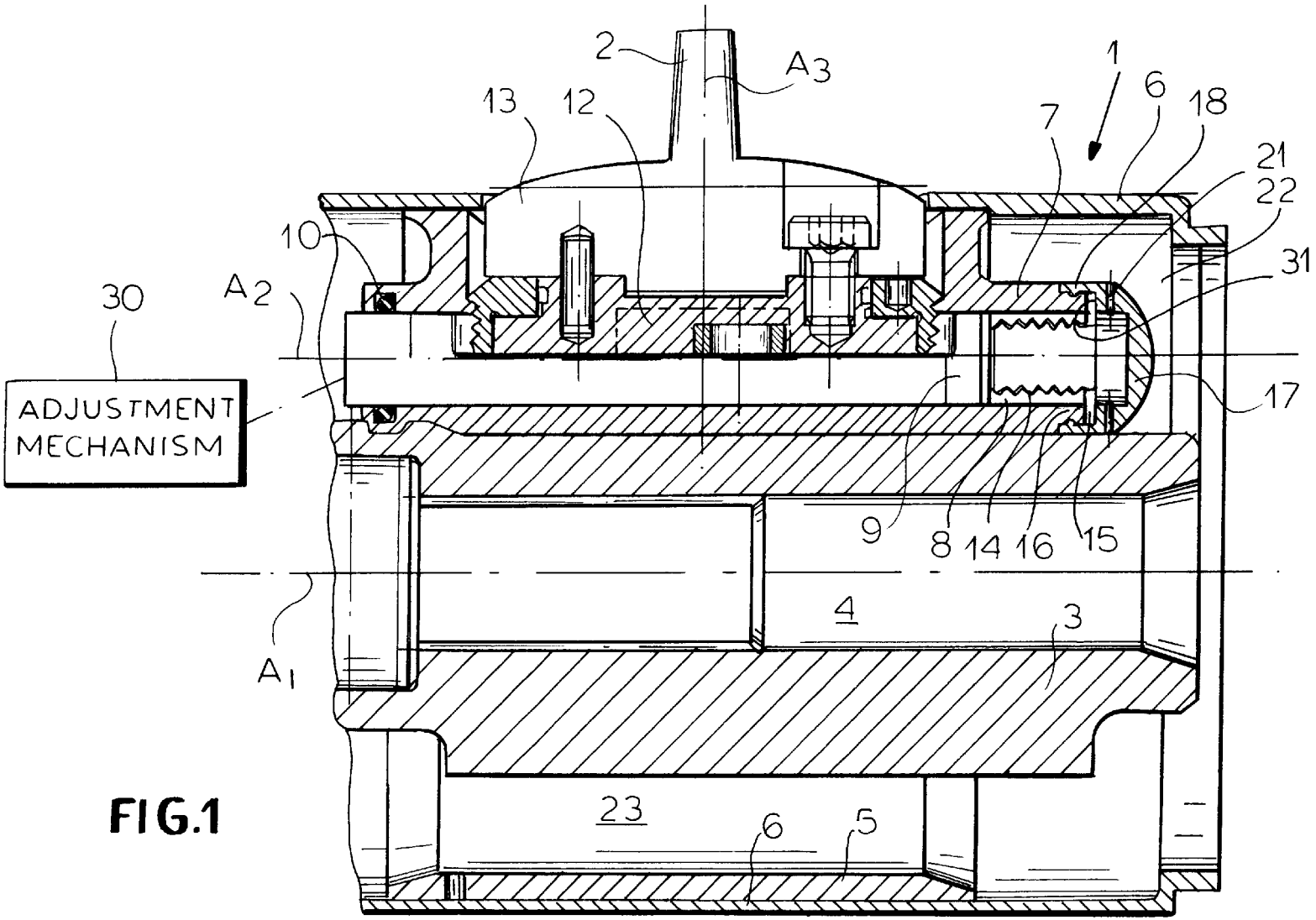
FIG. 1 is a partial section through a controllable-pitch propeller provided with the sealing arrangement according to the invention.
Figure 2:
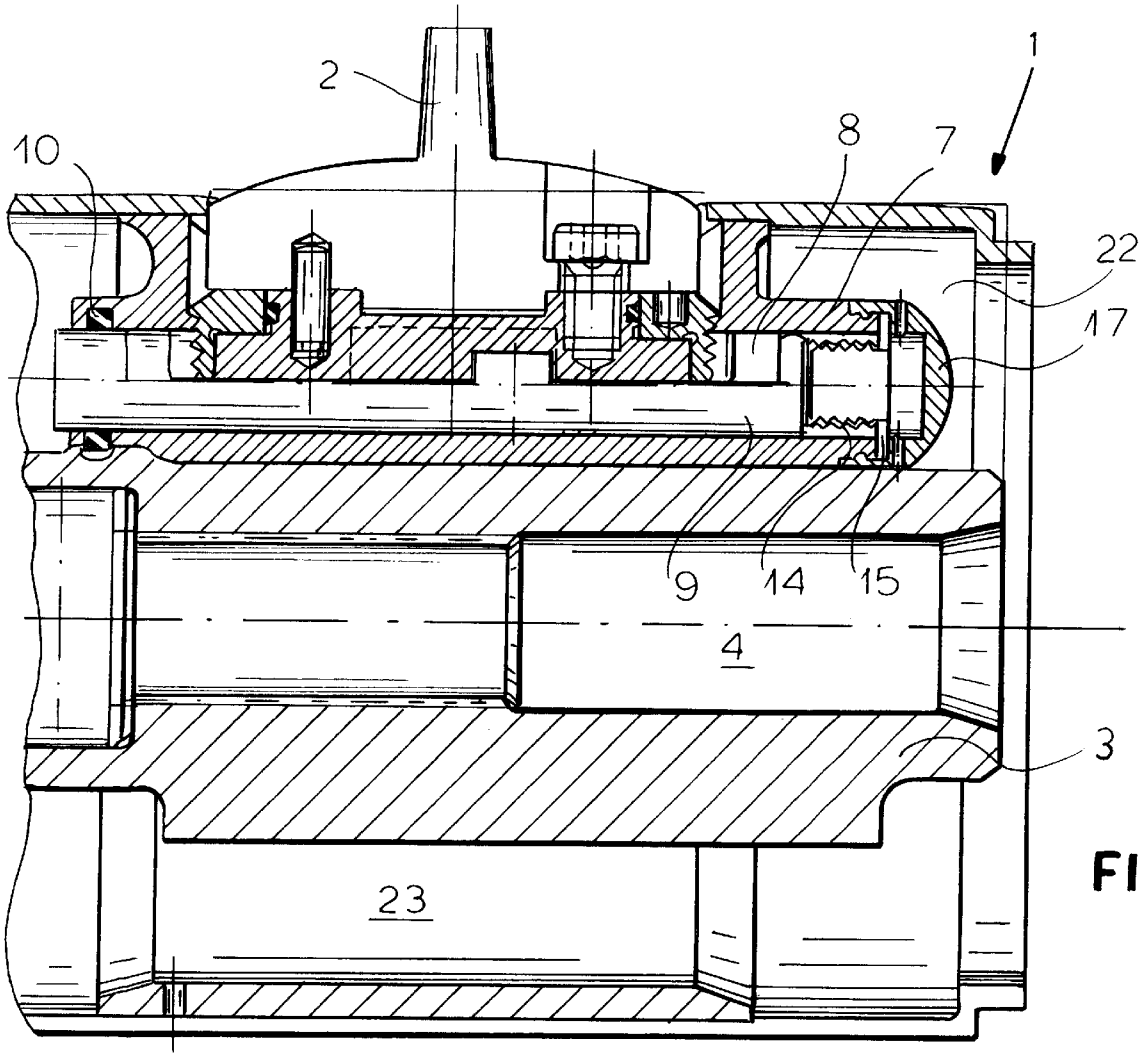
FIG. 2 is a view similar to FIG. 1 but showing the parts thereof in another functional position.

As can be seen from FIGS. 1–4 a controllable-pitch propeller can comprise a hub 1 having three blades 2 of which only one has been shown in the drawing. The hub 1 comprises a central hub body 3 with a bore or socket 4 receiving the drive shaft for the propeller. The body 3 is surrounded by a support ring 5 on which the hub shell 6 is mounted. The support ring 5 is provided with angularly equispaced housings 7 which are braced against the body 3 and have bores 8 parallel to the axis $A_1$ of rotation of the hub. The bore axes are represented at $A_2$. The axis $A_3$ represents the substantially radial axis of the blade 2 which is perpendicular to the axes $A_1$ and $A_2$.

Within each bore 8 a respective push rod 9 is axially displaceable and a seal 10 can be provided to seal the push rod at the left-hand end thereof at which the push rod can project from the housing 7. The push rod is connected to an adjustment mechanism 30 shown only in FIG. 1 and corresponding to the adjustment mechanism for actuating the push rods in, for example, U.S. Pat. No. 4,897,056.

Each push rod 9, in a central region thereof has a pin 11 which eccentrically engages an adjustment plate 12 journaled in the housing 7 of the hub 1 and connected to the base 13 of the respective blade 2.

At the right-hand end of each bore 8, a respective multifold bellows 14 is provided, the bellows having its closed end extending into the bore 8. The bellows 14 has an outer diameter which is substantially equal to the inner diameter of the bore 8.

At its open end, the bellows 14 has a radial flange 15 which abuts an end face of axial flange 16 of the respective housing and clamped against the axial flange by means of a cover or cap 17.

Figure 3:
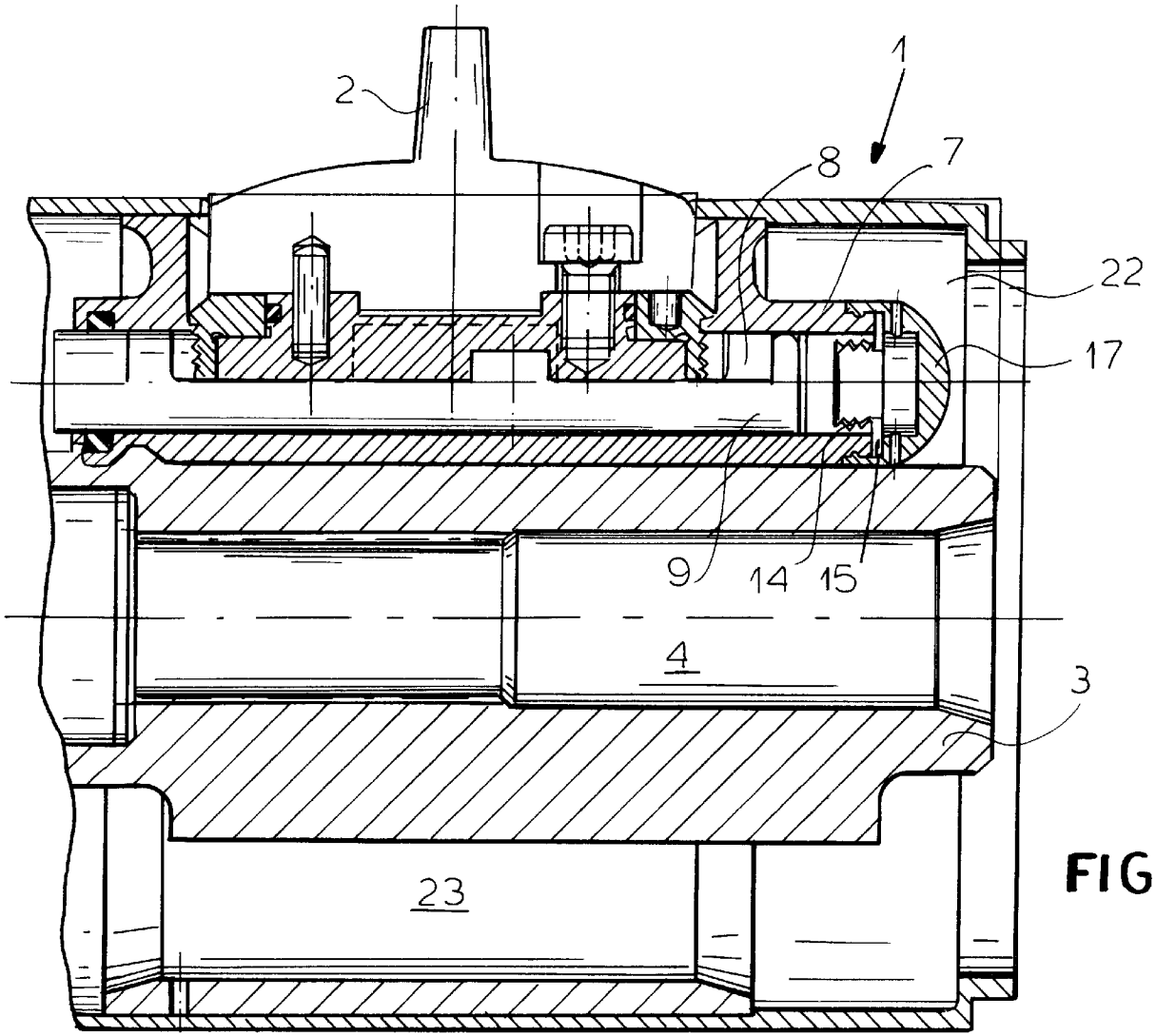
FIG. 3 is still another view similar to FIG. 1 with the parts in still another position.
Figure 4:
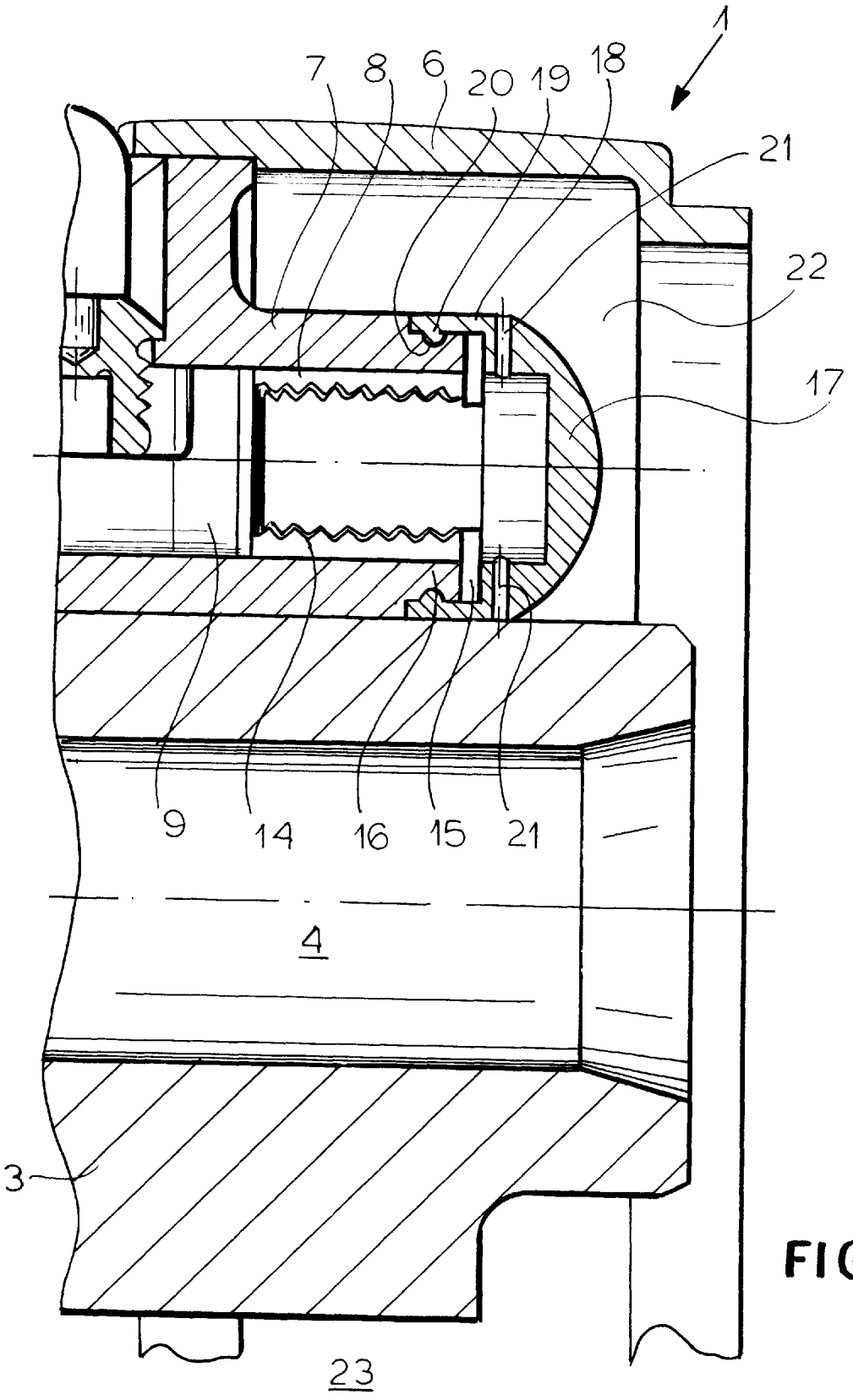
FIG. 4 is a detail drawn to a larger scale of the seal arrangement of FIGS. 1–3.

In the embodiment of FIGS. 1–4, the cover or cap 17 has a shoulder 31 bearing upon the radial flange 15 and surrounded by an apron 18 with an inwardly projecting circumferential rib 19 which engages resiliently in an outwardly open peripheral groove 20 of the axial flange (see especially FIG. 4). The cap 17 has openings 21 which are substantially perpendicular to the axis $A_2$ of the respective bore 8 and thus extend radially thereof. The bores 21 communicate between a gas space 22 in the hub which can be provided with exhaust gas channels 23 between the housing 7 over the entire length of the hub, and the interior of the respective bellows.

FIG. 1 shows an operating condition in which the push rod 9 is set for a small blade pitch. In this case, the closed end of the bellows 14 can lie against the end face of the push rod 9. In the operating position shown in FIG. 2 in which the push rod 9 is in a position corresponding to large blade pitch, the closed end of the bellows 14 also remains in contact with the end of the push rod, but the bellows has been compressed and with such compression, air or water in the bellows has been displaced through the openings 21 into the exhaust gas space 22.

FIG. 3 shows an operating position in which, in spite of the fact that the push rod 9 is in a position corresponding to a large blade pitch, between the closed end of the bellows 14 and the end face of the push rod 9, there is a large air volume which can result from expansion at high temperatures. The displacement of the push rod 9 is however not restricted because the bellows 14 can compensate for all volume changes. This also applies when water penetrates into a space between the end of the bellows 14 and the end face of the push rod 9.

Figure 5:
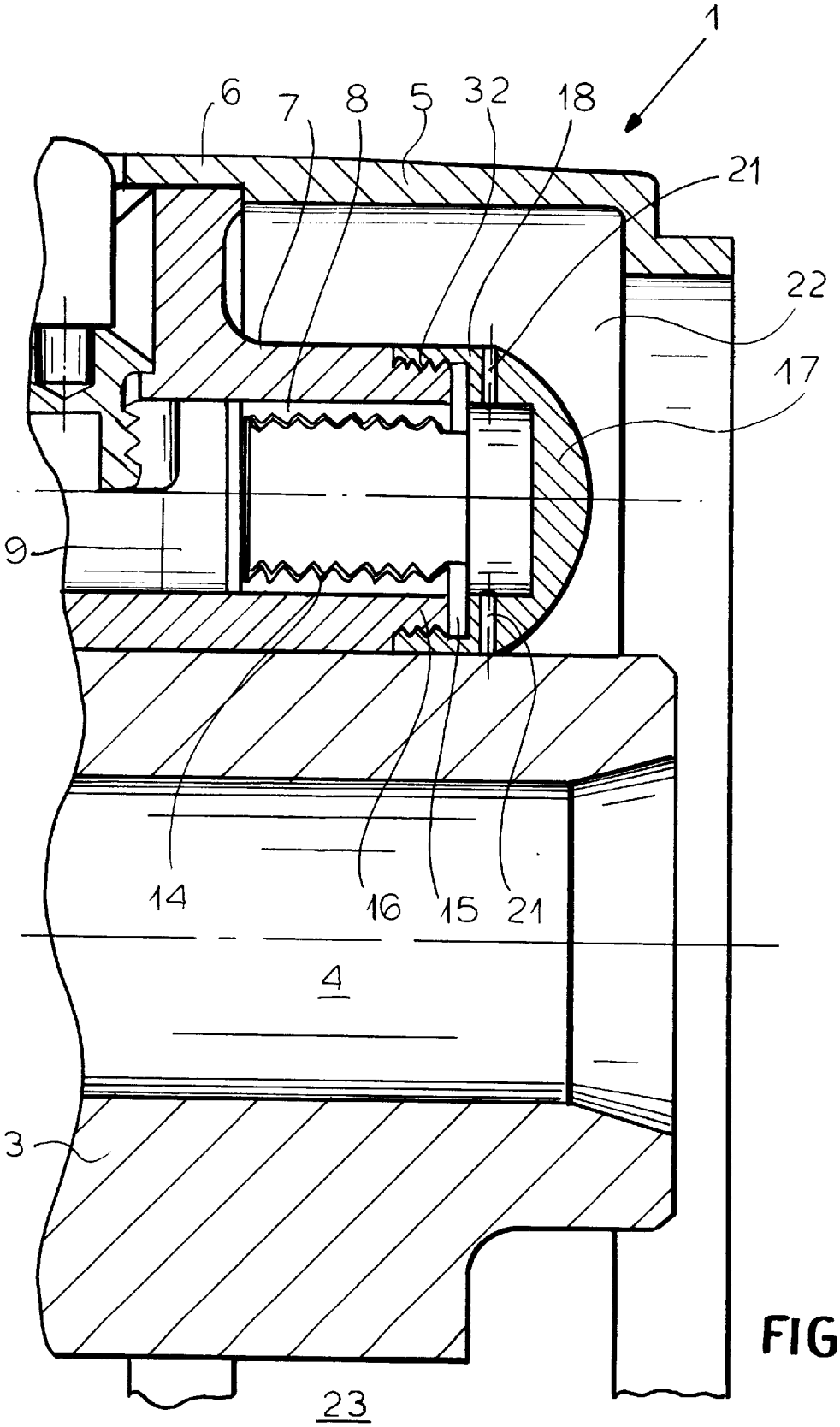
FIG. 5 is a view similar to FIG. 4 showing another embodiment.

FIG. 5 differs from FIG. 4 only in that a screw thread 32 is provided between the axial flange 16 and the apron 18 to releasably retain the cap 17 on the axial flange 16 in clamping the flange 15 of the bellows 14 against the axial flange.

In either case, in an increased volume formed by the freezing of water in a space between the bellows and the push rod can be compensated by further compression of the bellows. The push rod 19 is protected from the exhaust gases of the engine without a reduction in the cross section of the exhaust gas outlet formed by the hub. Furthermore, where there is a failure of the blade attachment seals, water can be drained easily without disassembling the pitch control mechanism simply by removing the cap and the multifold bellows.

I claim:

1. A controllable-pitch propeller for a water craft, said propeller comprising:

a hub having a housing rotatable about an axis of rotation;

a plurality of blades mounted on said housing and each angularly adjustable about a respective adjustment axis transverse to said axis of rotation;

an eccentric mechanism in said hub operatively coupled to said blades for angularly adjusting same about said adjustment axes to set a propeller pitch, said eccentric mechanism including at least one push rod guided in an axially extending bore formed in said housing and having an end open in said hub; and a multiple-fold bellows sealing said end of said bore.

2. The controllable-pitch propeller defined in claim 1 wherein said multiple-fold bellows has a closed extremity extending in said end of said bore toward an end of said push rod.

3. The controllable-pitch propeller defined in claim 2 wherein said multiple-fold bellows has an outer diameter substantially equal to an inner diameter of the bore at said end of said bore.

4. The controllable-pitch propeller defined in claim 3 wherein said multiple-fold bellows has an open end formed with a radial flange.

5. The controllable-pitch propeller defined in claim 4, further comprising a removable cap clamping said radial flange against a portion of said housing formed with said bore, said cap being provided with at least one opening.

6. The controllable-pitch propeller defined in claim 5 wherein said housing has an axial flange on which said cap is mounted.

7. The controllable-pitch propeller defined in claim 6 wherein said cap is connected to said axial flange by a screw thread.

8. The controllable-pitch propeller defined in claim 6 wherein said cap is clipped to said axial flange.

9. The controllable-pitch propeller defined in claim 8 wherein said cap is formed with an axially extending apron formed with an inwardly projecting circumferential rib and said axial flange has an outwardly open circumferential groove receiving said rib.

10. The controllable-pitch propeller defined in claim 6 wherein said cap is formed with an opening extending radially with respect to an axis of said bore.

11. The controllable-pitch propeller defined in claim 1 wherein said multiple-fold bellows has an outer diameter substantially equal to an inner diameter of the bore at said end of said bore.

12. The controllable-pitch propeller defined in claim 1 wherein said multiple-fold bellows has an open end formed with a radial flange.

13. The controllable-pitch propeller defined in claim 12, further comprising a removable cap clamping said radial flange against a portion of said housing formed with said bore, said cap being provided with at least one opening.

14. The controllable-pitch propeller defined in claim 13 wherein said housing has an axial flange on which said cap is mounted.

15. The controllable-pitch propeller defined in claim 14 wherein said cap is connected to said axial flange by a screw thread.

16. The controllable-pitch propeller defined in claim 14 wherein said cap is clipped to said axial flange.

17. The controllable-pitch propeller defined in claim 16 wherein said cap is formed with an axially extending apron formed with an inwardly projecting circumferential rib and said axial flange has an outwardly open circumferential groove receiving said rib.

18. The controllable-pitch propeller defined in claim 16 wherein said opening extends with respect to an axis of said bore.

* * * * *